US011505997B2

(12) United States Patent
Wan et al.

(10) Patent No.: US 11,505,997 B2
(45) Date of Patent: Nov. 22, 2022

(54) HORIZONTAL DRILLING MACHINE WITH AN IN-SITU DETECTION DEVICE

(71) Applicant: HUNAN UNIVERSITY OF SCIENCE AND TECHNOLOGY, Hunan (CN)

(72) Inventors: Buyan Wan, Hunan (CN); Yongping Jin, Hunan (CN); Fenfei Peng, Hunan (CN); Jialiang Wang, Hunan (CN); Huan Liu, Hunan (CN)

(73) Assignee: HUNAN UNIVERSITY OF SCIENCE AND TECHNOLOGY, Xiangtan (CN)

( * ) Notice: Subject to any disclaimer, the term of this patent is extended or adjusted under 35 U.S.C. 154(b) by 0 days.

(21) Appl. No.: 17/485,712

(22) Filed: Sep. 27, 2021

(65) Prior Publication Data

US 2022/0010624 A1 Jan. 13, 2022

(30) Foreign Application Priority Data

Dec. 18, 2020 (CN) ..... 202011504447.4

(51) Int. Cl.

| | |
|---|---|
| ***E21B 7/04*** | (2006.01) |
| ***E21B 3/02*** | (2006.01) |
| ***E21B 19/08*** | (2006.01) |
| ***E21B 19/10*** | (2006.01) |
| ***E21B 19/16*** | (2006.01) |
| ***E21B 31/18*** | (2006.01) |
| ***E21B 49/00*** | (2006.01) |

(52) U.S. Cl.

CPC ..... *E21B 7/046* (2013.01); *E21B 3/02* (2013.01); *E21B 19/08* (2013.01); *E21B 19/10* (2013.01); *E21B 19/161* (2013.01); *E21B 31/18* (2013.01); *E21B 49/003* (2013.01)

(58) Field of Classification Search

CPC . E21B 7/046; E21B 3/02; E21B 19/08; E21B 19/10; E21B 19/161; E21B 31/18; E21B 49/003

See application file for complete search history.

(56) References Cited

U.S. PATENT DOCUMENTS

| | | | | |
|---|---|---|---|---|
| 1,611,504 | A * | 12/1926 | Baker | E21B 25/00 175/235 |
| 2019/0338610 | A1* | 11/2019 | Shan | E21B 25/005 |
| 2022/0010622 | A1* | 1/2022 | Wan | E21B 31/113 |

* cited by examiner

*Primary Examiner* — Kristyn A Hall
(74) *Attorney, Agent, or Firm* — Wayne IP LLC

(57) ABSTRACT

A horizontal drilling machine with an in-situ detection device, including a support frame, an armored cable, a steel pipe-straightening mechanism, a steel pipe-feeding mechanism, a motor, a power head, a drill pipe, a rotating chuck, a damper, a non-core drilling tool, the in-situ detection device, a fishing device and a thrust cylinder. The steel pipe-straightening mechanism, the steel pipe-feeding mechanism, the rotating chuck and the damper are sequentially fixed on the support frame from left to right. One end of the thrust cylinder is hinged with the support frame, and the other end is connected to the power head. The active drill pipe of the power head is connected to the drill pipe. An end of the armored cable is connected to the fishing device in the drill pipe, and the fishing head of the fishing device is connected to the spearhead of the non-core drilling tool.

11 Claims, 7 Drawing Sheets

HORIZONTAL DRILLING MACHINE WITH AN IN-SITU DETECTION DEVICE

CROSS-REFERENCE TO RELATED APPLICATIONS

This application claims the benefit of priority from Chinese Patent Application No. 202011504447.4, filed on Dec. 18, 2020. The content of the aforementioned application, including any intervening amendments thereto, is incorporated herein by reference in its entirety.

TECHNICAL FIELD

This application relates to geological exploration, and more particularly to a horizontal drilling machine with an in-situ detection device.

BACKGROUND

With the rapid development of the trenchless technology in China, the horizontal drilling machine has become a commonly-used and powerful tool for the engineering geological exploration, and also plays an important role in the geological exploration and underground engineering. The horizontal drilling machine is a tool which is driven by a power device to explore underground resources and the underground engineering geology within a certain curvature radius, and has the characteristics of fast drilling speed, high efficiency, and large crossing length and drilling depth.

The existing detecting process is generally performed through the following steps. (1) The formation to be detected is drilled by a drilling equipment. (2) An in-situ detection device is arranged on a drill rod, and the drill rod is extended into the hole bottom for detection. (3) The drill rod is retracted after the detection. (4) The detection device is detached from the drilling rod, and the detection data is read. The existing detection devices can satisfy the needs of short-distance and short-time auxiliary operations, but they still suffer the following limitations. (1) A complete detection process, including delivery, salvaging and disassembling of the detection device, and the detection data reading, is extremely time-consuming. (2) The in-situ detection device may fall off during the retraction of the drill rod. With the increase of the exploration depth, especially when the exploration depth reaches hundreds or thousands of meters, the detection operation will take a lot of time, and the detection depth and the detection timeliness will be seriously restricted by the data reading manner.

SUMMARY

An object of this application is to provide a horizontal drilling machine with an in-situ detection device to overcome the defects in the prior art, where the horizontal drilling machine has a simple and compact structure and convenient operations, and can greatly increase the exploration depth.

The technical solutions of this application are described as follows.

This application provides a horizontal drilling machine with an in-situ detection device, comprising:

a support frame;
an armored cable;
a steel pipe-straightening mechanism;
a steel pipe-feeding mechanism;
a washing pump;

a motor;
a power head;
a drill pipe;
a rotating chuck;
a damper;
a non-core drilling tool;
an in-situ detection device;
a fishing device;
a thrust cylinder;
a photoelectric slip ring;
a data collection device; and
a computer;

wherein the steel pipe-straightening mechanism and the steel pipe-feeding mechanism are fixedly provided on the support frame; one end of the thrust cylinder is hinged with the support frame, and the other end of the thrust cylinder is connected to the power head; the power head is arranged on a slide rail of the support frame; a piston rod of the thrust cylinder is configured to drive the power head to move on the slide rail by extension and retraction; the power head is connected to the drill pipe through an active drill pipe to drive the drill pipe to rotate; the armored cable is wound on a storage rack; one end of the armored cable is connected to the data collection device through the photoelectric slip ring; the data collection device is connected to the computer; the other end of the armored cable passes through the steel pipe-straightening mechanism, the steel pipe-feeding mechanism and a sealing joint to be connected to the fishing device arranged in the drill pipe; the sealing joint is arranged on the power head, and is communicated with an inner cavity of the active drill pipe; a fishing head of the fishing device is connected to a spearhead of the non-core drilling tool to drill a hard rock strata, or the fishing head of the fishing device is connected to a spearhead of the in-situ detection device to detect a conical tip resistance, a side friction and a pore water pressure in a penetration path of a soft strata; a water outlet of the washing pump is communicated with the inner cavity of the active drill pipe; and a rotating water-supply device is arranged on the power head.

In an embodiment, the steel pipe-straightening mechanism comprises multiple sets of rolling wheels; the multiple sets of rolling wheels are fixedly arranged on the support frame; each set of rolling wheels comprises two rolling wheels; axes of the two rolling wheels in the same set are located in a vertical plane; and vertical planes in which axes of the multiple sets of rolling wheels are located are parallel to each other.

In an embodiment, the steel pipe-feeding mechanism comprises a casing, an upper friction wheel and a lower friction wheel; the upper friction wheel and the lower friction wheel are fixedly arranged in the casing; an axis of the upper friction wheel is parallel to an axis of the lower friction wheel; the axis of the upper friction wheel and the axis of the lower friction wheel are located in a vertical plane; and the vertical plane in which the axis of the upper friction wheel and the axis of the lower friction wheel are located is parallel to the vertical planes in which the axes of the multiple sets of rolling wheels are located; the casing is provided with a through-hole for the armored cable to pass through; and a wheel shaft of the lower friction wheel is connected to a motor via a speed reducer.

In an embodiment, the rotating chuck and the damper are arranged on an end of the support frame near a drill hole; the damper is configured to clamp the drill pipe; and the rotating chuck is configured to connect the drill pipe with the active drill pipe.

In an embodiment, the power head comprises the motor, a reduction gearbox, a transmission shaft and the active drill pipe; the motor is arranged on the reduction gearbox; an output shaft of the motor is located in the reduction gearbox; the output shaft of the motor is provided with a driving gear; the transmission shaft is arranged in the reduction gearbox and is provided with a first driven gear and a second driven gear; the active drill pipe is arranged on the reduction gearbox, and is provided with a third driven gear; the driving gear is engaged with the first driven gear; the second driven gear is engaged with the third driven gear; an axis of the output shaft of the motor is parallel to the transmission shaft and the active drill pipe; and an end of the active drill pipe extending out of the reduction gearbox is provided with a screw thread.

In an embodiment, the diameter of the sealing joint is larger than that of the armored cable; and a seal ring is arranged between the sealing joint and the armored cable.

In an embodiment, the damper comprises a first oil cylinder, a second oil cylinder, two slip assemblies, a top plate, a bottom plate, and two side plates. The top plate and the bottom plate and the two side plates together form a square tubular structure; the square tubular structure is arranged on the support frame; the top plate is provided with a first drill pipe hole for the drill pipe to pass through; the bottom plate is provided with a second drill pipe hole for the drill pipe to pass through; the first and second drill pipe holes are coaxially provided; the two slip assemblies are respectively arranged on both sides of the first and second drill pipe holes; slips of the two slip assemblies are arranged opposite to each other; the first oil cylinder and the second oil cylinder are arranged on the support frame, and respectively located at two ends of the square tubular structure; and piston rods of the first oil cylinder and the second oil cylinder II are arranged opposite to each other and are respectively connected to the two slip assemblies.

In an embodiment, the rotating chuck comprises an oil motor, a reduction gearbox, a first transmission shaft, a second transmission shaft, a protecting tube, a rotating oil-separating tube, a fixed oil-separating tube, a slip assembly and a centralizer. The oil motor is arranged on the reduction gearbox; an output shaft of the oil motor is located in the reduction gearbox; the output shaft of the oil motor is provided with a driving gear. The first transmission shaft is provided in the reduction gearbox, and the first transmission shaft and the second transmission shaft are arranged in the reduction gearbox; the first transmission shaft is provided with a first driven gear and a second driven gear; the second transmission shaft is provided in the reduction gearbox; the second transmission shaft is provided with a third driven gear and a fourth driven gear; the fixed oil-separating tube is arranged on a bottom plate of the reduction gearbox; an annular oil groove is arranged on a side of the fixed oil-separating tube; the fixed oil-separating tube is sleeved in the rotating oil-separating tube; the rotating oil-separating tube is provided with a fifth driven gear; the driving gear is engaged with the first driven gear, the second driven gear is engaged with the third driven gear; and the fourth driven gear is engaged with the fifth driven gear; the output shaft of the oil motor is parallel to axes of the first transmission shaft, the second transmission shaft and the fixed oil-separating tube, and is located in the same plane with the axes of the first transmission shaft, the second transmission shaft and the fixed oil-separating tube; the protecting tube is connected to the reduction gearbox through a bolt; the slip assembly is arranged in the protecting tube and is connected to the rotating oil-separating tube; the centralizer is arranged on the protecting tube; and the reduction gearbox is fixedly arranged on the support frame; and the fixed oil-separating tube is coaxial with the drill pipe.

In an embodiment, the in-situ detection device comprises a locking mechanism, an electronic bin, and a detecting probe; the locking mechanism, the electronic bin, and the detecting probe are coaxially arranged; and a bottom of the locking mechanism is connected to the electronic bin, and the electronic bin is connected to the detecting probe; and when the in-situ detection device is transported to a designated position, a tapered end of the electronic bin is in contact with an inner end surface of a drill bit connected to the drill pipe.

In an embodiment, the non-core drilling tool comprises a locking mechanism, an inner pipe, and a drill bit; a bottom of the locking mechanism is connected to an upper end of the inner pipe; and a lower end of the inner pipe is connected to the drill bit.

In an embodiment, the fishing head of the fishing device comprises two first metal rings parallel to each other; the two first metal rings are arranged perpendicular to an axis of the fishing device; the spearhead of the in-situ detection device is provided with two second metal rings respectively corresponding to the two first metal rings; and the two second metal rings are arranged perpendicular to an axis of the spearhead of the in-situ detection device.

Compared with the prior art, this disclosure has the following beneficial effects.

In the horizontal drilling machine provided herein, the lowering and retrieving of the in-situ detection device are performed by means of pressure of the fluid medium and the pushing of the armored cable, and at the same time, two sets of metal rings (each set consists of a metal ring I and a metal ring II) for the signal transmission are arranged on the fishing device and the spearhead of the in-situ detection device which are connected by an armored cable An non-core drilling tool is provided for the drilling on a hard strata. Specifically, the armored cable passes through the sealing joint to be connected to the fishing device, and the fishing device is provided with two parallel metal rings I used for the signal transmission. For a soft stratum, after the in-situ detection device connected to the fishing device is released in place, the thrust cylinder pushes the active drill pipe connected to the power head to move downward, and thus the in-situ detection device is driven to penetrate the stratum to collect in-situ detection data such as the conical tip resistance, the side friction and the pore water pressure on the penetration path. Subsequently, the data signal is transmitted to the data collection device through the armored cable, meanwhile, the real-time analysis can be carried out through the computer. For a hard stratum, the in-situ detection device is fished and retrieved to the drilling hole via the fishing device, and the non-core drilling tool is connected to the fishing device. When the non-core drilling tool is released in place, the power head is pushed by the thrust cylinder drives to perform rotary drilling, thereby realizing the non-core drilling of the stratum. In this way, the delivery and recovery of the in-situ detection device and the non-core drilling tool between the alternating soft and hard formations can be realized, and thus improving the exploration depth. The horizontal drilling machine provided herein has a simple and compact structure and convenient operations.

Figure 1:
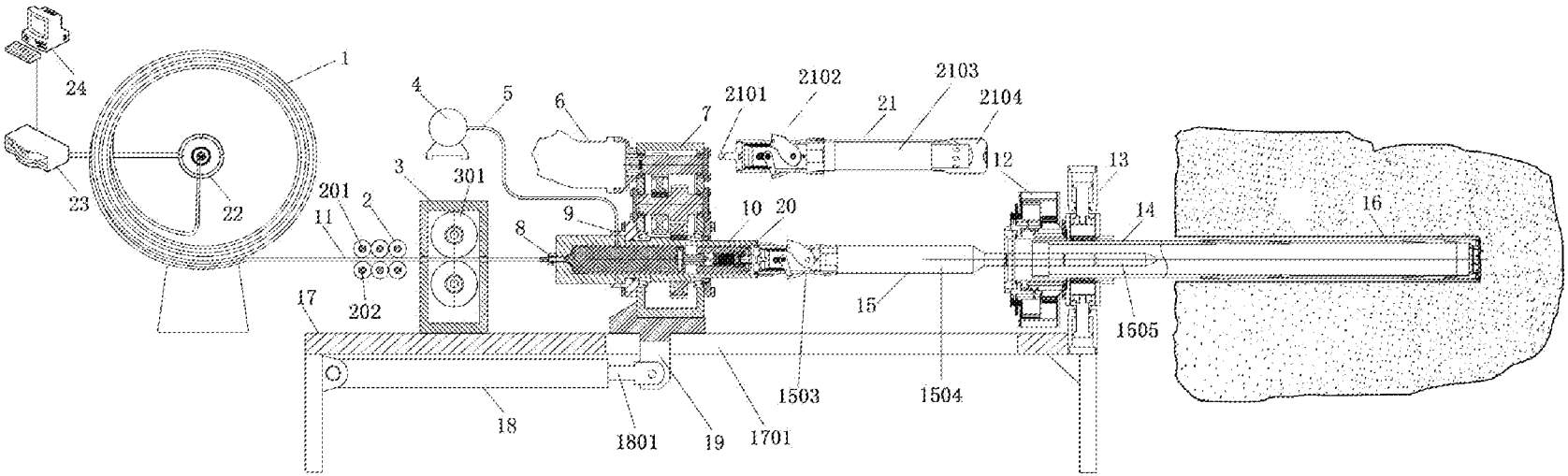
FIG. 1 is a structural diagram of a horizontal drilling machine with an in-situ detection device according to an embodiment of this disclosure.

In the drawings, 1, storage rack; 2, steel pipe-feeding mechanism; 3, steel pipe-straightening mechanism; 4, washing pump; 5, water pipe; 6, motor; 7, power head; 8, sealing joint; 9, rotating water-supply device; 10, active drill pipe; 11, armored cable; 12, rotating chuck; 13, damper; 14, drill pipe; 15, in-situ detection device; 16, drilling tool; 17, support frame; 18, thrust cylinder; 19, connecting block; 20, fishing device; 21, non-core drilling tool; 22, photoelectric slip ring; 23, data collection device; and 24, computer.

DETAILED DESCRIPTION OF EMBODIMENTS

The disclosure will be further described below in detail with reference to the accompanying drawings and embodiments.

As shown in FIG. 1, an embodiment of the disclosure provides a horizontal drilling machine, including a storage rack 1, a steel pipe-feeding mechanism 2, a steel pipe-straightening mechanism 3, a water pipe 5, a motor 6, a power head 7, a sealing joint 8, a rotating water-supply device 9, an active drill pipe 10, an armored cable 11, a rotating chuck 12, a damper 13, a drill pipe 14, an in-situ detection device 15, a drilling tool 16, a support frame 17, a thrust cylinder 18, a connecting block 19, a fishing device 20, a non-core drilling tool 21, a photoelectric slip ring 22, a data collection device 23 and a computer 24. The steel pipe-straightening mechanism 3, the steel pipe-feeding mechanism 2, the rotating chuck 12 and the damper 13 are fixed on the support frame 17 in sequence from left to right. The right end of the support frame 17 is arranged near a drill hole. One end of the thrust cylinder 18 is hinged with the support frame 17, and the other end of the thrust cylinder 18 is connected to the power head 7 through the connecting block 19. The power head is arranged on a slide rail 1701 of the support frame, and a piston rod 1801 of the thrust cylinder 18 is configured to drive the power head 7 to move back and forth on the slide rail 1701 by extension and retraction.

Figure 2:
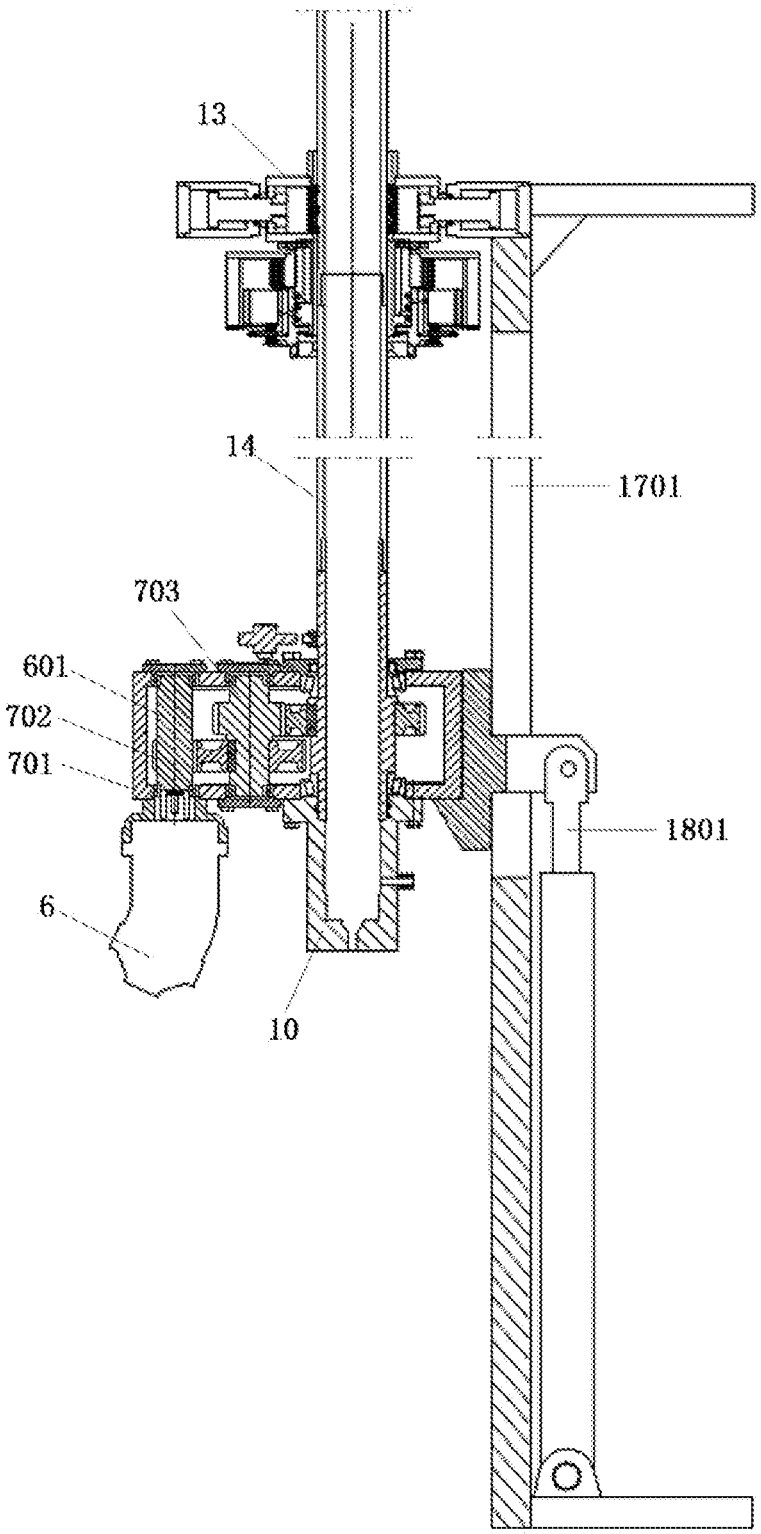
FIG. 2 is a sectional view of a power head of the horizontal drilling machine according to an embodiment of this disclosure.

Referring to an embodiment illustrated in FIG. 2, the power head 7 includes the motor 6, a reduction gearbox 701, a transmission shaft 703 and an active drill pipe 10. The motor 6 is arranged on the reduction gearbox 701, and an output shaft 601 of the motor 6 is located in the reduction gearbox 701 and is provided with a driving gear 702. The transmission shaft 703 is arranged in the reduction gearbox 701, and is provided with a driven gear I and a driven gear II. The active drill pipe 10 is arranged on the reduction gearbox 701, and is provided with a driven gear III. The driving gear 702 is engaged with the driven gear I. The driven gear II is engaged with the driven gear III. An axis of the output shaft 601 of the motor is parallel to the transmission shaft 703 and the active drill pipe 10. An end of the active drill pipe 10 extending out of the reduction gearbox 701 is threadedly connected to the drill pipe 14.

Figure 3:
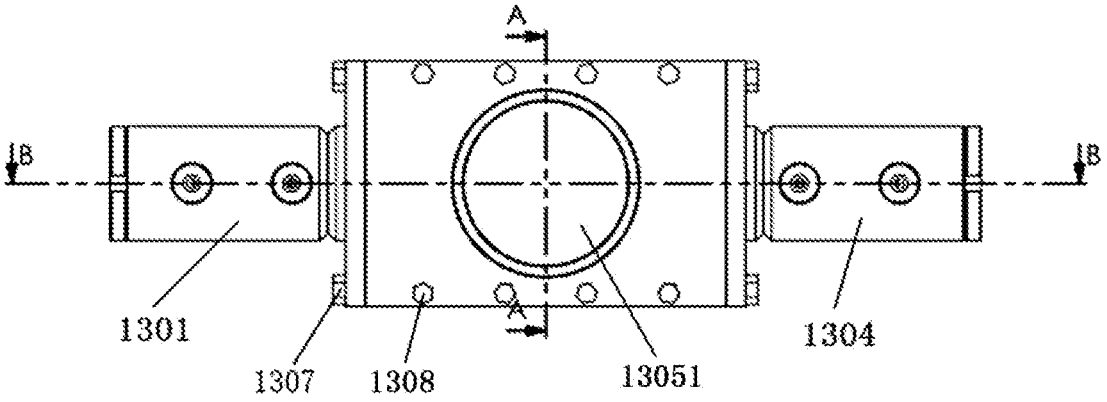
FIG. 3 is a front view of a damper of the horizontal drilling according to an embodiment of this disclosure.
Figure 4:
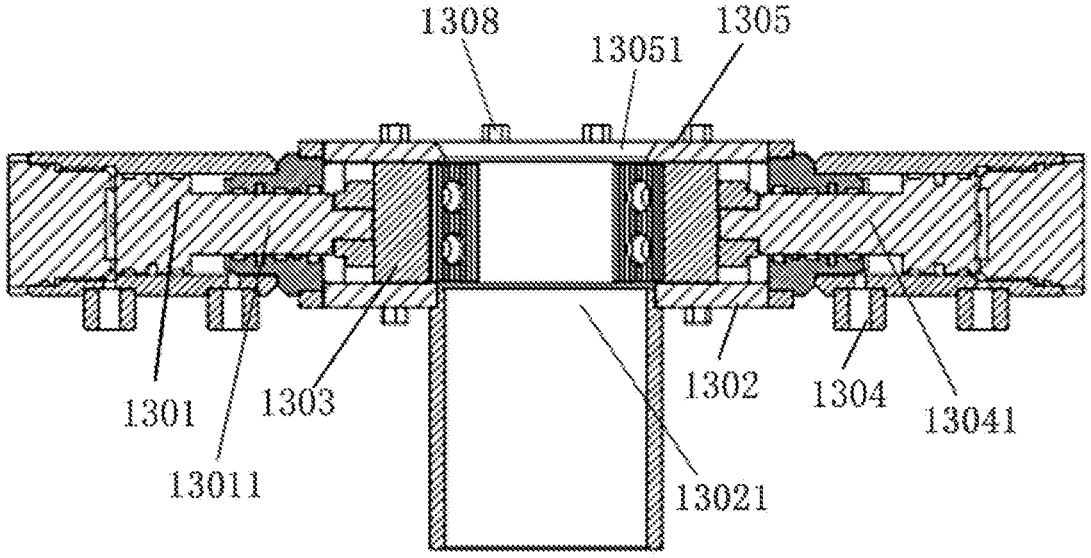
FIG. 4 is a sectional view of the damper along B-B line in FIG. 3.

The damper 13 is arranged for clamping the drill pipe 14 to guide the drill pipe 14. As shown in FIG. 3 and FIG. 4, the damper 13 includes an oil cylinder I 1301, an oil cylinder II 1304, two slip assemblies 1303, a top plate 1305, a bottom plate 1302, and two side plates 1307. The top plate 1305 and the bottom plate 1302 are connected to the two side plates 1307 through bolts 1308 to form a square tubular structure, and the square tubular structure is arranged on the support frame 17. The top plate 1305 is provided with a first drill pipe hole 13051 for the drill pipe to pass through, and the bottom plate 1302 is provided with a second drill pipe hole 13021 for the drill pipe to pass through; and the first and second drill pipe holes are coaxially provided. The two slip assemblies 1303 are respectively arranged on both sides of the drill pipe holes, and the slips of the two slip assemblies 1303 are arranged opposite to each other. The oil cylinder I 1301 and the oil cylinder II 1304 are arranged on the support frame, and respectively located at two ends of the square tubular structure; piston rods 13011 and 13041 of the oil cylinder I 1301 and the oil cylinder II 1304 are arranged opposite to each other, and are respectively connected to the two slip assemblies 1303. The oil cylinder I 1301 and the oil cylinder II 1304 promote the relative movement of the two slip assemblies 1303 to clamp the drill pipe 14.

Figure 5:
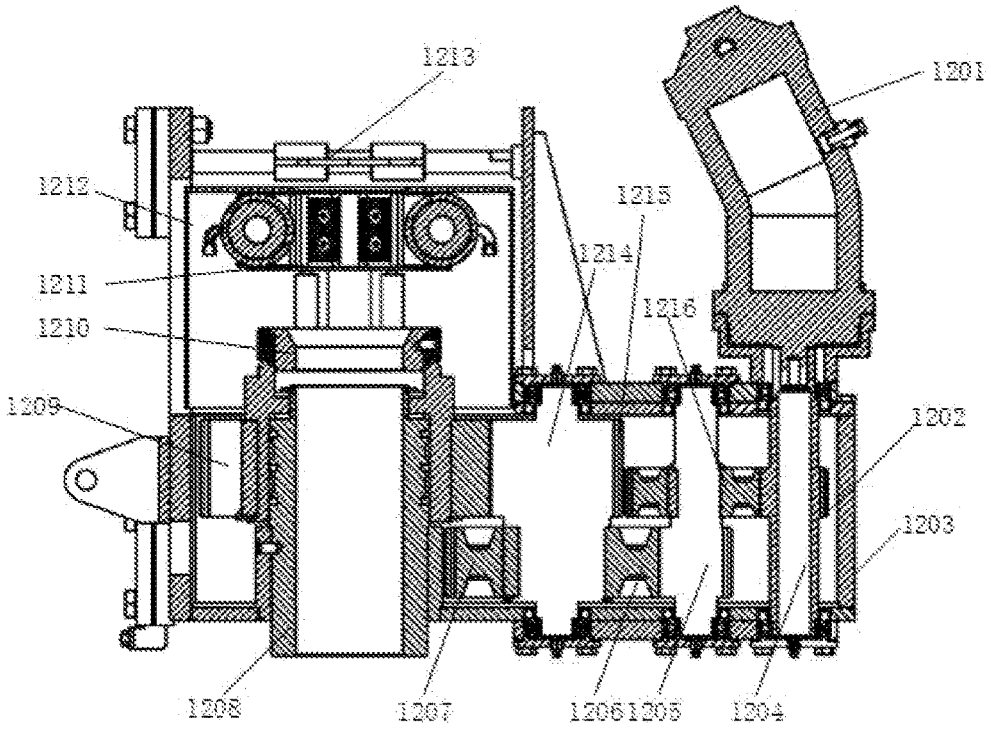
FIG. 5 is a sectional view of a rotating chuck of the horizontal drilling machine according to an embodiment of this disclosure.

In an embodiment illustrated in FIG. 5, the rotating chuck 12 includes an oil motor 1201, a reduction gearbox 1203, a transmission shaft I 1205, a transmission shaft II 1214, a protecting tube 1212, a rotating oil distributor 1210, a fixed oil-separating tube 1208, a slip assembly 1211 and a centralizer 1213. The oil motor 1201 is arranged on the reduction gearbox 1203, and an output shaft 1204 of the oil motor is provided in the reduction gearbox 1203. The output shaft 1204 of the oil motor is provided with a driving gear II 1202. The transmission shaft I 1205 and the transmission shaft II 1214 are arranged in the reduction gearbox 1203, the transmission shaft I 1205 is provided with a driven gear IV 1216 and a driven gear V 1206, the transmission shaft II 1214 is provided with a driven gear VII 1215 and a driven gear VI 1207. The fixed oil-separating tube 1208 is arranged on the bottom plate of the reduction gearbox 1203, an annular oil groove is arranged on the side of the fixed oil-separating tube 1208, and the fixed oil-separating tube 1208 is sleeved in the rotating oil-separating tube 1210. The rotating oil-separating tube 1210 is provided with a driven gear VIII 1209. The driving gear II 1202 is engaged with the driven gear IV 1216, and the driven gear V 1206 is engaged with the driven gear VI 1207, the driven gear VII 1215 is engaged with the driven gear VIII 1209. The output shaft 1204 is parallel to axes of the transmission shaft I 1205, the transmission shaft II 1214 and the fixed oil-separating tube 1208, and is located in the same plane with the axes of the transmission shaft I 1205, the transmission shaft II 1214 and the fixed oil-separating tube 1208. The protecting tube 1212 is connected to the reduction gearbox 1203 through bolts. The slip assembly 1211 is arranged in the protecting tube 1212 and is connected to the rotating oil distributor 1210. The centralizer 1213 is arranged on the protecting tube 1212 and plays a role in centralizing the drill pipe. The reduction gearbox is fixedly arranged on the support frame, and the fixed oil-separating tube is coaxial with the drill pipe.

In an embodiment illustrated in FIG. 5, the armored cable 11 is wound on a storage rack 1. An end of the armored cable 11 is connected to the data collection device 23 through the photoelectric slip ring 22, the data collection device 23 is connected to the computer 24, and the other end of the armored cable 11 is connected to the fishing device 20 arranged in the drill pipe 14 through the steel pipe-straightening mechanism 3, the steel pipe-feeding mechanism 2 and the sealing joint 8. The sealing joint 8 is arranged on the power head 7 and is communicated with an inner cavity of the active drill pipe 10. The diameter of the sealing joint 8 is larger than that of the armored cable 11, and a seal ring is arranged between the sealing joint 8 and the armored cable 11.

Figure 6:
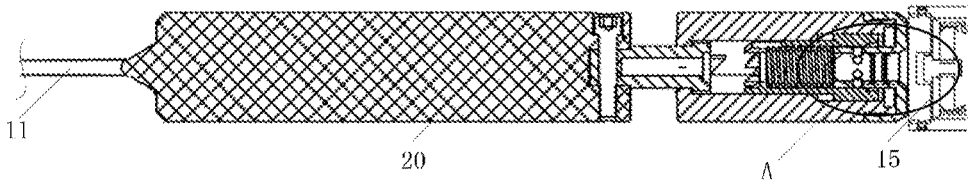
FIG. 6 is a sectional view of the signal transmission according to an embodiment of this disclosure.
Figure 7:
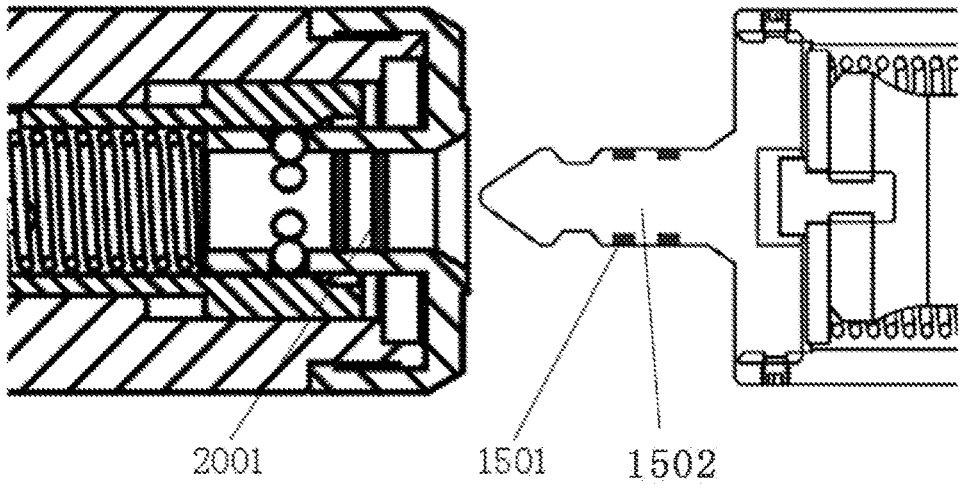
FIG. 7 is an exploded view of part A in FIG. 6.
Figure 9:
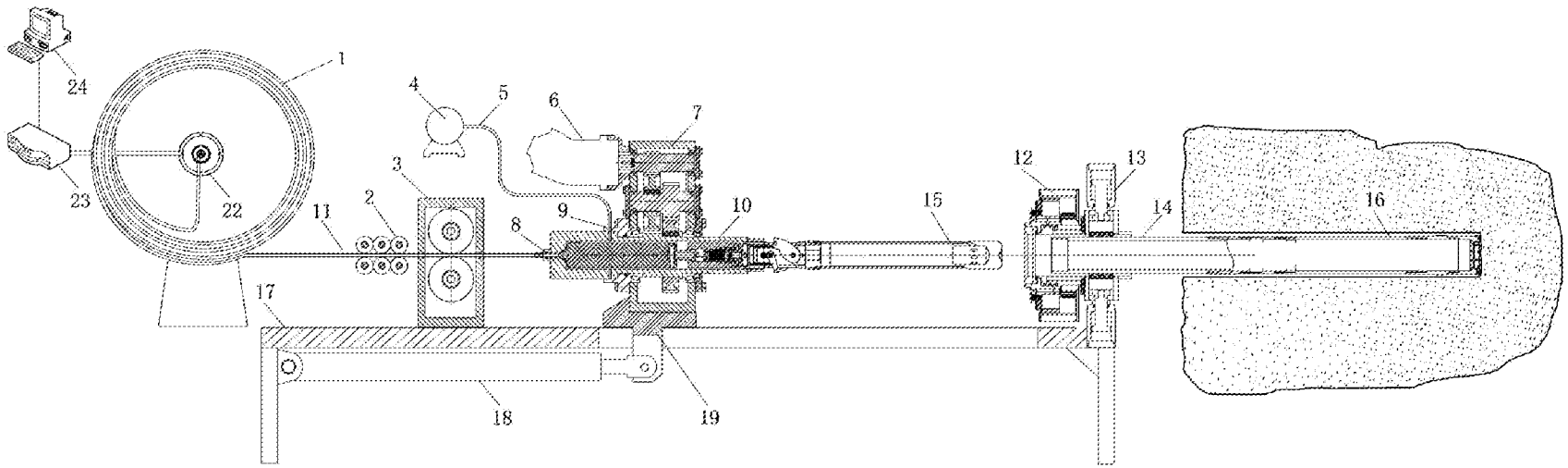
FIG. 9 schematically depicts the pipe replacement of the horizontal drilling machine according to an embodiment of this disclosure.

The fishing head of the fishing device 20 is connected to the in-situ detection device 15 or the non-core drilling tool 21 according to the hardness of the strata. For a soft stratum, as shown in FIG. 6 and FIG. 7, the fishing head of the fishing device 20 is connected to the spearhead 1502 of the in-situ detection device 15 to detect a conical tip resistance, a side friction and a pore water pressure in a penetration path. The fishing head of the fishing device contains two metal rings I 2001 parallel to each other; and the two metal rings I 2001 are arranged perpendicular to an axis of the fishing device. The spearhead 1502 of the in-situ detection device is provided with two metal rings II 1501 respectively corresponding to the two metal rings I, and the two metal rings II 1501 are arranged perpendicular to an axis of the spearhead 1502 of the in-situ detection device. The in-situ detection device connected to the spearhead 1502 includes a locking mechanism 1503, an electronic bin 1504, and a detecting probe 1505. The locking mechanism 1503, the electronic bin 1504, and the detecting probe 1505 are coaxially arranged. A bottom of the locking mechanism 1503 is connected to the electronic bin 1504. When the electronic bin is connected to the detecting probe, and the in-situ detection device is transported to a designated position, a tapered end of the electronic bin is in contact with an inner end surface of a drill bit connected to the drill pipe. For a hard stratum, as shown in FIG. 9, the fishing head of the fishing device 20 is connected to the spearhead 2101 of the non-core drilling tool 21 to drill the hard rock stratum. The non-core drilling tool 21 includes a locking mechanism 2102, an inner pipe 2103, and a drill bit 2104; and the locking mechanism 2102, the inner pipe 2103, and the drill bit 2104 are coaxially arranged. A bottom of the locking mechanism 2102 is connected to an upper end of the inner pipe 2103, and a lower end of the inner pipe 2103 is connected to the drill bit 2104.

In an embodiment illustrated in FIG. 1, the steel pipe-straightening mechanism 3 includes three sets of rolling wheels 301 (the rolling wheels are not limited to three sets); the three sets of rolling wheels 301 are fixedly arranged on the support frame 17; each set of the rolling wheels 301 includes two rolling wheels 301, and vertical planes in which axes of the multiple sets of the rolling wheels 301 are located are parallel to each other. The steel pipe-feeding mechanism 2 includes a casing, an upper friction wheel 201, and a lower friction wheel 202. The upper friction wheel and the lower friction wheel are fixedly arranged in the casing; an axis of the upper friction wheel 201 is parallel to an axis of the lower friction wheel 202; the axis of the upper friction wheel 201 and the axis of the lower friction wheel 202 are located in a vertical plane; and the vertical plane in which the axis of the upper friction wheel 201 and the axis of the lower friction wheel 202 are located is parallel to the vertical planes in which the axes of multiple sets of the rolling wheels 301 are located. The casing is provided with a through-hole for the armored cable 11 to pass through; and a wheel shaft of the lower friction wheel 202 is connected to the motor via a speed reducer, the motor drives the lower friction wheel 202 to rotate to transport the armored cable 11.

Figure 8:
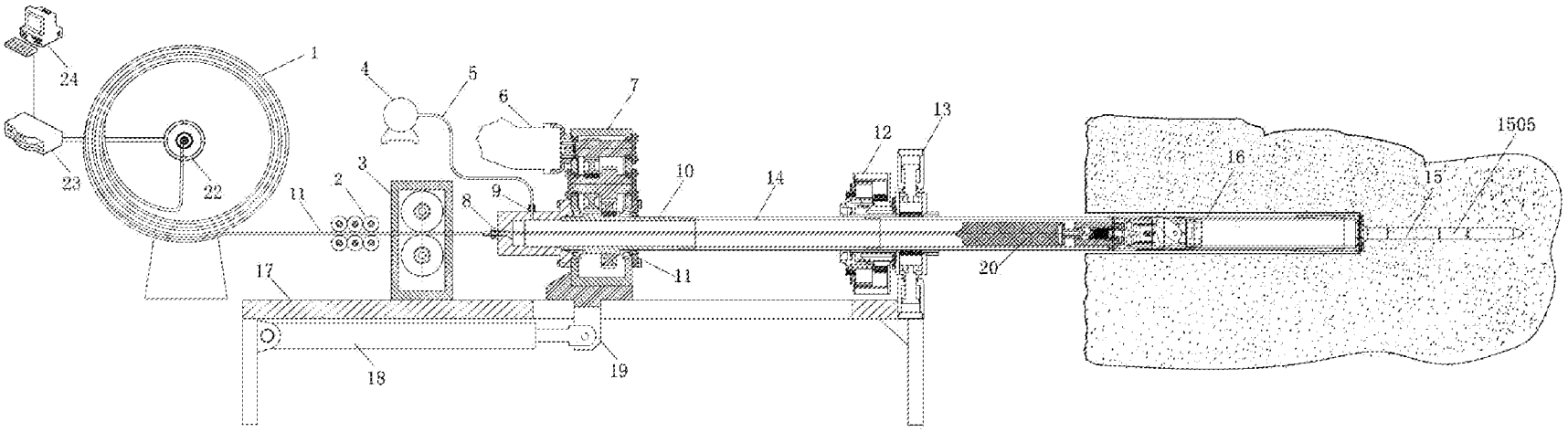
FIG. 8 schematically depicts the detection of the horizontal drilling machine according to an embodiment of this disclosure.

In an embodiment illustrated in FIG. 8, before the drilling operation, the active drill pipe 10 is threadedly connected to the rear end of the drill pipe 14, and a front-end thread part of the drill pipe 14 is arranged in the rotating chuck 12. The drill pipe 14 is connected to the detection device of the drilling tool 16 through the rotating chuck 12, and the damper 13 clamps and fixes the drill pipe 14. The armored cable 11 on the support frame 17 passes the sealing joint 8 to be connected to the fishing device 20, and the fishing device 20 is connected to the spearhead 1502 of the in-situ detection device 15 in the drilling tool 16. The drilling tool 15 is driven by the motor of the steel pipe-feeding mechanism 2 to move downward to a target position. At the beginning of detection, the thrust cylinder 18 drives the driving head 7 to move back and forth on the slide rail 1701 of the support frame 17. Thus, a front-end probing head of the in-situ detection device 15 of the drilling tool 16 is pressed into the stratum to collect the in-situ detection data such as the cone-tip resistance, the side friction, and the pore water pressure of the stratum on the penetration path, and those data are transmitted to the data collection device 23 through the armored cable 11, meanwhile, real-time analysis is carried out through the computer 24 until the round trip of drilling is completed.

Figure 10:
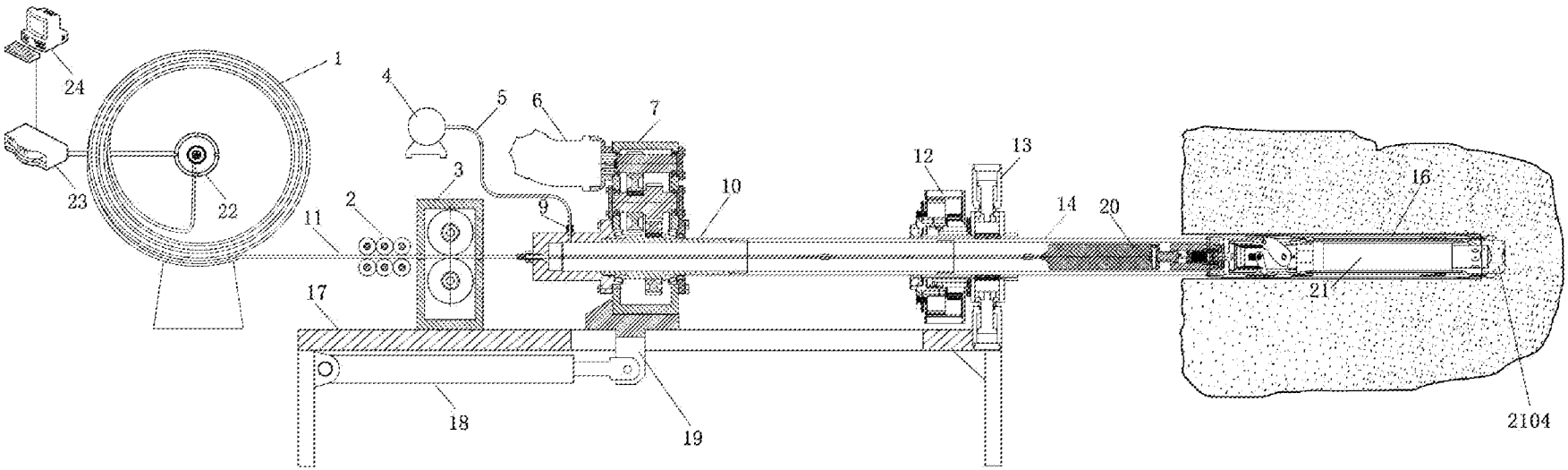
FIG. 10 schematically depicts the drilling of the horizontal drilling machine according to an embodiment of this disclosure.

As shown in FIG. 9 and FIG. 10, when the horizontal drilling machine provided herein encounters hard rock strata, the thrust cylinder 18 stops moving forward; the power head 7 stops rotating; and the washing pump 4 stops pumping water. At this time, the rotating chuck 12 unscrewed the thread between the active drill pipe 10 and the drill pipe 14, and the thrust cylinder 18 drives the power head 7 to move back to the position before the drilling. At the same time, the in-situ detection device 15 clamped by the fishing device 20 is lifted to the mouth of the drill hole to complete one exploration operation. Subsequently, an inner pipe 2103 is installed on the non-core drilling tool, and the new drill pipe 14 is connected to the active drill pipe 10 through the rotating chuck 12. Then the previous operations repeat to achieve rapid fast and effective rock fragmentation.

Referring to an embodiment illustrated in FIG. 9, before the drilling, the active drill pipe 10 is threadedly connected to the rear end of the drill pipe 14. A front-end thread part of the drill pipe 14 is arranged in the rotating chuck 12, and the connection between the drill pipe 14 and the inner pipe 2103 of the non-core drilling tool 21 of the drilling tool 16 is achieved through the rotating chuck 12. The damper 13 is configured to fixedly clamp the drill pipe 14. The armored cable 11 on the support frame 17 passes through the sealing joint 8 to be connected to the fishing device 20, and the fishing device 20 is connected to the spearhead 2101 on the inner pipe 2103 of the non-core drilling tool 21 in the drilling tool 16. The motor of the steel pipe-feeding mechanism 2 drives the inner pipe 2103 of the non-core drilling tool 21 to be lowered to a designated position. At the beginning of the drilling, the thrust cylinder 18 drives the power head 7 to move back and forth on the slide rail 1701 of the support frame 17 through the extension and retraction of the piston rod 1801, so that the frontend of the drilling bit of the drilling tool 16 is rotationally pressed into the stratum until the round trip is complete.

What is claimed is:

1. A horizontal drilling machine with an in-situ detection device, comprising:

a support frame;

an armored cable;

a steel pipe-straightening mechanism;

a steel pipe-feeding mechanism;

a washing pump;

a motor;

a power head;

a drill pipe;

a rotating chuck;

a damper;

a non-core drilling tool;

an in-situ detection device;

a fishing device;

a thrust cylinder;

a photoelectric slip ring;

a data collection device; and a computer;

wherein the steel pipe-straightening mechanism and the steel pipe-feeding mechanism are fixedly provided on the support frame; one end of the thrust cylinder is hinged with the support frame, and the other end of the thrust cylinder is connected to the power head; the power head is arranged on a slide rail of the support frame; a piston rod of the thrust cylinder is configured to drive the power head to move on the slide rail by extension and retraction; the power head is connected to the drill pipe through an active drill pipe to drive the drill pipe to rotate; the armored cable is wound on a storage rack; one end of the armored cable is connected to the data collection device through the photoelectric slip ring; the data collection device is connected to the computer; the other end of the armored cable passes through the steel pipe-straightening mechanism, the steel pipe-feeding mechanism and a sealing joint to be connected to the fishing device arranged in the drill pipe; the sealing joint is arranged on the power head, and is communicated with an inner cavity of the active drill pipe; the fishing device is connected to a spearhead of the non-core drilling tool to drill a hard rock strata, or the fishing device is connected to a spearhead of the in-situ detection device to detect a conical tip resistance, a side friction and a pore water pressure in a penetration path of a soft strata; the washing pump is communicated with the inner cavity of the active drill pipe; and a rotating water-supply device is arranged on the power head.

2. The horizontal drilling machine of claim 1, wherein the steel pipe-straightening mechanism comprises multiple sets of rolling wheels; the multiple sets of rolling wheels are fixedly arranged on the support frame; each set of rolling wheels comprises two rolling wheels; axes of the two rolling wheels in the same set are located in a vertical plane; and vertical planes in which axes of the multiple sets of rolling wheels are located are parallel to each other.

3. The horizontal drilling machine of claim 2, wherein the steel pipe-feeding mechanism comprises a casing, an upper friction wheel and a lower friction wheel; an axis of the upper friction wheel is parallel to an axis of the lower friction wheel; the axis of the upper friction wheel and the axis of the lower friction wheel are located in a vertical plane; and the vertical plane in which the axis of the upper friction wheel and the axis of the lower friction wheel are located is parallel to the vertical planes in which the axes of the multiple sets of rolling wheels are located; and the lower friction wheel is connected to a motor.

4. The horizontal drilling machine of claim 1, wherein the rotating chuck and the damper are arranged on an end of the support frame near a drill hole; the damper is configured to clamp the drill pipe, and the rotating chuck is configured to connect the drill pipe with the active drill pipe or disconnect the drill pipe from the active drill pipe.

5. The horizontal drilling machine of claim 4, wherein the rotating chuck comprises an oil motor, a reduction gearbox, a first transmission shaft, a second transmission shaft, a protecting tube, a rotating oil-separating tube, a fixed oil-separating tube, a slip assembly and a centralizer; the oil motor is arranged on the reduction gearbox; an output shaft of the oil motor is located in the reduction gearbox; the output shaft of the oil motor is provided with a driving gear; the first transmission shaft and the second transmission shaft are arranged in the reduction gearbox; the first transmission shaft is provided with a first driven gear and a second driven gear; the second transmission shaft is provided in the reduction gearbox; the second transmission shaft is provided with a third driven gear and a fourth driven gear; the fixed oil-separating tube is arranged on a bottom plate of the reduction gearbox; the fixed oil-separating tube is sleeved in the rotating oil-separating tube; the rotating oil-separating tube is provided with a fifth driven gear; the driving gear is engaged with the first driven gear; the second driven gear is engaged with the third driven gear; the fourth driven gear is engaged with the fifth driven gear; the output shaft of the oil motor is parallel to axes of the first transmission shaft, the second transmission shaft and the fixed oil-separating tube, and is located in the same plane with the axes of the first transmission shaft, the second transmission shaft and the fixed oil-separating tube; the protecting tube is connected to the reduction gearbox through a bolt; the slip assembly is arranged in the protecting tube and is connected to the rotating oil-separating tube; the centralizer is arranged on the protecting tube; the reduction gearbox is fixedly arranged on the support frame; and the fixed oil-separating tube is coaxial with the drill pipe.

6. The horizontal drilling machine of claim 4, wherein the damper comprises a first oil cylinder, a second oil cylinder, two slip assemblies, a top plate, a bottom plate and two side plates; the top plate, the bottom plate and the two side plates together form a square tubular structure; the square tubular structure is arranged on the support frame; the top plate is provided with a first drill pipe hole for the drill pipe to pass through; the bottom plate is provided with a second drill pipe hole for the drill pipe to pass through; the first and second drill pipe holes are coaxially provided; and the two slip assemblies are respectively arranged on both sides of the first and second drill pipe holes; and slips of the two slip assemblies are arranged opposite to each other; the first oil cylinder and the second oil cylinder are arranged on the support frame and respectively located at two ends of the square tubular structure; and piston rods of the first oil cylinder and the second oil cylinder are arranged opposite to each other, and are respectively connected to the two slip assemblies.

7. The horizontal drilling machine of claim 1, wherein the power head comprises the motor, a reduction gearbox, a transmission shaft and the active drill pipe; the motor is arranged on the reduction gearbox; an output shaft of the motor is located in the reduction gearbox; the output shaft of the motor is provided with a driving gear; the transmission shaft is arranged in the reduction gearbox; the active drill pipe is arranged on the reduction gearbox; an axis of the output shaft of the motor is parallel to the transmission shaft and the active drill pipe; and an end of the active drill pipe extending out of the reduction gearbox is threadedly connected to the drill pipe.

8. The horizontal drilling machine of claim 1, wherein a diameter of the sealing joint is larger than that of the armored cable.

9. The horizontal drilling machine of claim 1, wherein the in-situ detection device comprises a locking mechanism, an electronic bin and a detecting probe; the locking mechanism, the electronic bin and the detecting probe are coaxially arranged; a bottom of the locking mechanism is connected to the electronic bin; and the electronic bin is connected to the detecting probe.

10. The horizontal drilling machine of claim 1, wherein the non-core drilling tool comprises a locking mechanism, an inner pipe and a drill bit; and a bottom of the locking mechanism is connected to an upper end of the inner pipe; and a lower end of the inner pipe is connected to the drill bit.

11. The horizontal drilling machine of claim 1, wherein the fishing device comprises two first metal rings parallel to each other; the two first metal rings are arranged perpendicular to an axis of the fishing device; the spearhead of the in-situ detection device is provided with two second metal rings respectively corresponding to the two first metal rings; and the two second metal rings are arranged perpendicular to an axis of the spearhead of the in-situ detection device.

* * * * *